US010909899B2

(12) United States Patent
Marcu et al.

(10) Patent No.: US 10,909,899 B2
(45) Date of Patent: Feb. 2, 2021

(54) OPTIMUM CHROMATICITY CALIBRATION

(71) Applicant: Apple Inc., Cupertino, CA (US)

(72) Inventors: Gabriel Marcu, San Jose, CA (US); Shahram Peyvandi, Santa Clara, CA (US); Lu Zhang, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/428,213

(22) Filed: May 31, 2019

(65) Prior Publication Data

US 2020/0380907 A1 Dec. 3, 2020

(51) Int. Cl.
*G09G 3/20* (2006.01)

(52) U.S. Cl.
CPC ..... *G09G 3/2003* (2013.01); *G09G 2310/08* (2013.01); *G09G 2320/0693* (2013.01); *G09G 2354/00* (2013.01); *G09G 2360/16* (2013.01)

(58) Field of Classification Search
CPC ..... G09G 2310/08; G09G 2320/0693; G09G 2354/00; G09G 2360/16; G09G 3/2003
See application file for complete search history.

(56) References Cited

U.S. PATENT DOCUMENTS 6,504,950 B1 * 1/2003 Murashita ..... G09G 1/165 358/500
6,690,383 B1 * 2/2004 Braudaway ..... G09G 5/006 345/600
8,654,141 B2 2/2014 Zhang
9,001,133 B2 4/2015 Kim
2012/0038688 A1 * 2/2012 Deyama ..... G09G 5/02 345/690
2013/0314447 A1 * 11/2013 Wu ..... G09G 3/006 345/690
2014/0009485 A1 * 1/2014 Asanuma ..... G09G 5/02 345/590
2014/0043369 A1 * 2/2014 Albrecht ..... G09G 5/02 345/690
2015/0243250 A1 * 8/2015 Fukuda ..... G09G 3/006 345/589
2016/0261860 A1 * 9/2016 Gu ..... H04N 17/04
2016/0307485 A1 * 10/2016 Ma ..... G09G 3/36
2016/0350940 A1 12/2016 Wang
2017/0162097 A1 * 6/2017 Pan ..... G09G 3/3413
2019/0251929 A1 * 8/2019 Fossati ..... G09G 5/02

* cited by examiner

*Primary Examiner* — Hong Zhou
(74) *Attorney, Agent, or Firm* — Blank Rome LLP

(57) ABSTRACT

A display panel is initialized to a native state where no color corrections are applied. A native response of the display panel is measured in the native state. One or more calibration operations for the display panel are performed based on the measured native response and calibration data is generated. The generated calibration data is stored in a timing controller (TCON) chip of the display panel. One or more chromaticity values of the display panel are measured while driving the display panel in a calibrated state based on the generated calibration data. The measured chromaticity value of the display panel is stored as Extended Display Identification Data (EDID) or DisplayID data in the TCON.

20 Claims, 6 Drawing Sheets

(γ = 1.0 ACHIEVED)
"RESULTANT GAMMA"

"LOOK UP TABLE"

OPTIMUM CHROMATICITY CALIBRATION

TECHNICAL FIELD

This disclosure relates generally to a method and system for RGB chromaticity calibration of a display. More particularly, but not by way of limitation, this disclosure relates to performing color management operations based on chromaticities of primary colors that are measured while driving the display in a calibrated state based on generated calibration data.

BACKGROUND

Modern consumer electronic devices incorporate display devices (e.g., liquid crystal display (LCD), organic light emitting diode (OLED), plasma, digital light processing (DLP), and the like) to exchange information with users. Operational characteristics of the display devices may vary from device to device due to inherent properties of the display devices. For example, variations may exist in LCD components, such as backlight variations due to light emitting diode (LED) wavelength and phosphor concentration, color filter thickness, and the like. Thus, each display device may have slightly different color characteristics, white point, and the like.

SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one embodiment, a display calibration method includes: initializing a display panel to a native state (e.g., by bypassing calibration data stored in an on-board memory of the display panel so as to drive the display panel without any corrections being applied based on the calibration data); measuring a native response of the display panel; performing one or more calibration operations for the display panel based on the measured native response and generating calibration data; storing the generated calibration data in an on-board memory of the display panel; measuring a chromaticity value of the display panel while driving the display panel in a calibrated state based on the generated calibration data (e.g., by measuring a maximum intensity of one or more primary chromaticities of the display panel); and storing the measured chromaticity value of the display panel into the on-board memory.

In another embodiment, the method further includes receiving an indication to calibrate the display panel from a user (e.g., via a user interface of a calibration system implementing the display calibration method and connected to a system of the display panel), wherein the display panel is initialized to the native state, and the native response of the display panel is measured in response to receiving the indication to calibrate the display panel, and receiving via the user interface an indication of a measurement instrument to be used for measuring the native response of the display panel. In another embodiment, the on-board memory comprises a timing controller (TCON) provided on-board the display panel for driving the display panel, and the measured chromaticity value of the display panel is stored as Extended Display Identification Data (EDID) or DisplayID Data in the TCON. In yet another embodiment, the one or more calibration operations performed for the display panel include white point calibration, gray tracking calibration, and panel response calibration. In yet another embodiment, a chromaticity value of at least one of the primary chromaticities of the display panel measured while driving the display panel in the calibrated state is different from a chromaticity value of the at least one of the primary chromaticities of the display panel measured while driving the display panel in the native state.

In yet another embodiment, the method may be embodied in computer executable program code and stored in a non-transitory storage device. In yet another embodiment, the method may be implemented on a system.

BRIEF DESCRIPTION OF THE DRAWINGS

While certain embodiments will be described in connection with the illustrative embodiments shown herein, the invention is not limited to those embodiments. On the contrary, all alternatives, modifications, and equivalents are included within the spirit and scope of the invention as defined by the claims. In the drawings, which are not to scale, the same reference numerals are used throughout the description and in the drawing figures for components and elements having the same structure, and primed reference numerals are used for components and elements having a similar function and construction to those components and elements having the same unprimed reference numerals.

DESCRIPTION

Figure 1:
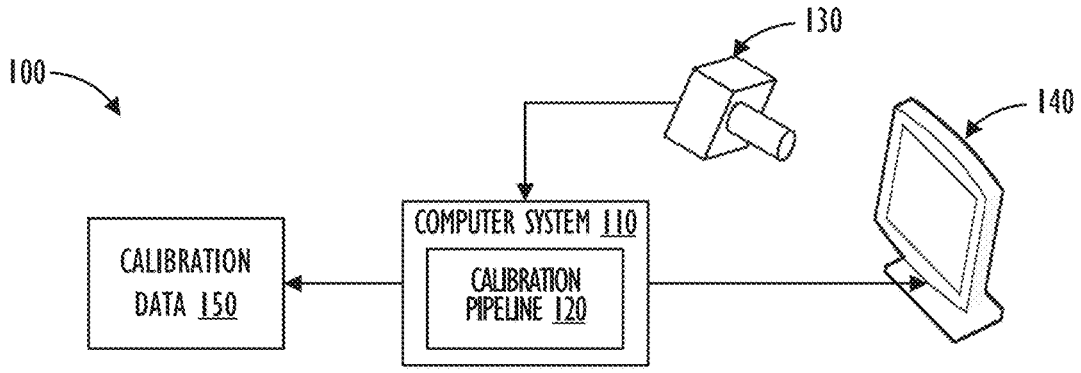
FIG. 1 shows, in block diagram form, a calibration system for calibrating a display, in accordance with one or more embodiments.

In the following description, for purposes of explanation, numerous specific details are set forth in order to provide a thorough understanding of the inventive concept. As part of this description, some of this disclosure's drawings represent structures and devices in block diagram form in order to avoid obscuring the invention. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" or "another embodiment" means that a particular feature, structure, or characteristic described in connection with the embodiment is included in at least one embodiment of the invention, and multiple references to "one embodiment" or "an embodiment" or "another embodiment" should not be understood as necessarily all referring to the same embodiment.

It will be appreciated that in the development of any actual implementation (as in any development project), numerous decisions must be made to achieve the developers' specific goals (e.g., compliance with system- and business-related constraints), and that these goals may vary from one implementation to another. It will also be appreciated that such development efforts might be complex and time-consuming, but would nevertheless be a routine undertaking for those of ordinary skill in the design and implementation of signal processing having the benefit of this disclosure.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one." The term "or" means any of the alternatives and any combination of the alternatives, including all of the alternatives, unless the alternatives are explicitly indicated as mutually exclusive. The phrase "at least one of" when combined with a list of items, means a single item from the list or any combination of items in the list. The phrase does not require all of the listed items unless explicitly so defined.

This disclosure pertains to improving primary color calibration performed in a calibration pipeline for a display panel. Primary color calibration can be applied as part of a factory calibration pipeline or as part of post-factory calibration performed by a user. In general, any error in primary color calibration (e.g., RGB chromaticity calibration) results in suboptimal color rendition on the screen, or in some cases, to objectionable color artifacts because the primary chromaticity coordinates (e.g., RGB chromaticity values, maximum intensity values) are used in International Color Consortium (ICC) profiles, and consequently, by a color management system associated with the display device to render image data on the display. For example, any discrepancy between: (i) chromaticities of primary colors that a display advertises (e.g., in the EDID, or DisplayID of a timing controller (TCON) chip of a display panel) as being capable of reproducing, and (ii) chromaticities actually reproducible by the display (e.g., after calibration), is a source of error. Techniques disclosed herein look to reduce this error by implementing novel chromaticity calibration techniques as part of a calibration pipeline for a display panel.

The calibration pipeline may aim to measure and/or adjust color response of a display panel to a known state. The calibration pipeline may include setting the display panel to be calibrated in a native mode where no color corrections are applied. In the native mode, chromaticities of RGB primaries (e.g., maximum intensities displayable in the native state for each color channel) of the display may be measured together with other parameters of the display. These measurements may then be used for calibration of the display including, e.g., white point, gray tracking and panel response calibrations. The result of these corrections may be stored in the form of tables or numeric values (e.g., one or more look up tables (LUTs)). These results may constitute calibration information or calibration data of the display, that may be flashed (e.g., stored or recorded) into an on-board memory (e.g., TCON, EDID, or DisplayID) of the display for driving the panel. TCON may be a chip provided on-board the display panel to drive the display panel. TCON may store the calibration information or data used to apply corrections to image data output to the display panel.

The novel chromaticity calibration technique according to the present disclosure may involve re-measuring chromaticities of RGB primaries of the display while driving the display in a calibrated state (e.g., maximum intensities of each color channel displayable by the display in the calibrated state) based on calibration data flashed in the on-board memory (i.e., after the display calibration). By re-measuring chromaticities of RGB primaries of the display after the calibration, the chromaticity calibration technique is able to account for any adjusted level (e.g., less than a 'native' level) of maximum intensity for each color channel the display panel is able to reach under the calibration constraints forced by the generated calibration data. The chromaticity calibration technique may then record the re-measured primary color chromaticity values in the on-board memory (e.g., TCON, EDID, or DisplayID) of the display so as to update the calibration information.

When the display is connected to a system, an operating system (OS) may detect the display's EDID (or DisplayID) data and automatically build an ICC profile with the correct re-measured chromaticity coordinates included in the calibration information. The ICC profile may then be used, e.g., by an integrated color management system of the OS, to accurately transform any RGB system color into an RGB display color within the display color gamut displayable on the calibrated screen. The calibration pipeline with the novel chromaticity calibration thus ensures that there is an accurate correspondence between the physical behavior of the calibrated panel and the ICC profile that models this behavior. As a consequence, color reproduction accuracy of the display is improved, the robustness of the color calibration pipeline is increased, and also, yield of the calibration process when the pipeline is implemented as part of a factory calibration during manufacture is increased because of fewer rejections during a verification process. The color calibration pipeline with the novel chromaticity calibration techniques described herein can also be implemented as a part of a post-factory calibration pipeline, e.g., for on-demand self-calibration of the display panel by a user in the field.

Referring now to FIG. 1, calibration system 100 for performing calibration of a display panel in accordance with one or more embodiments is illustrated. Calibration system 100 may include display 140 (e.g., display device, display panel, and the like). Display 140 may be a standard gamut or wide gamut display and may be used to display text and graphic output as well as receiving user input via a user interface. The design and implementation of display 140 may differ depending on the type of the display device. Non-limiting examples of display device types include liquid crystal displays, plasma displays, quantum dot-based displays, digital light processing based display (e.g., projector), and light emitting diode displays (e.g., organic light emitting diode displays), and the like. Display 140 may be a standalone display device like a computer monitor, television screen, and the like, or may be a display panel incorporated into an electronic device like a digital camera, a personal digital assistant (PDA), personal music player, mobile telephone, server, notebook, laptop, desktop, tablet computer, or other portable electronic device. In one embodiment, display 140 is an RGB display with color channels for red, green, and blue primaries (e.g., RGB sub-pixels).

Calibration system 100 may be implemented as part of an assembly line in a factory during manufacture of display 140 for performing calibration of display 140 before shipping to a customer. Alternately, calibration system 100 may be implemented as an external calibration system that can be utilized 'on-demand' by customers to self-calibrate display 140 by connecting calibration system 100 to a system of display 140. Calibration system 100 may further include measurement unit 130 (e.g., measurement instrument) that may be connected to and controlled by computer system 110. Measurement unit 130 may be any commercially available or custom color calibration instrument like a spectroradiometer, a tristimulus colorimeter, or a photometer. Measurement unit 130 may be a portable or stationary instrument that can be used by a user 'on-demand' to self-calibrate display 140. Alternately, measurement unit 130 may be provided on-board display 140.

Computer system 110 may include standard computer components like central processing unit (CPU), read-only memory (ROM), random access memory (RAM), storage device (e.g., hard disk), input/output devices (e.g., keyboard, mouse, monitor) and the like. Calibration pipeline 120 for performing display 140 calibration may be implemented on computer system 110. Calibration performed by calibration pipeline 120 for display 140 may include different types of calibration operations. For example, calibration pipeline 120 may perform white point calibration, gray tracking calibration, panel response calibration, RGB chromaticity calibration, luminance calibration, and the like for display 140. Panel response calibration may include gamma calibration, gray tracking calibration, and other corrections for shadow or highlights. Specific details of calibration performed by calibration pipeline 120 are described below in connection with FIGS. 3 and 6.

During one or more of the calibration operations, computer system 110 may control operation of display 140, output test and calibration image or video color calibration signals (e.g., still and/or moving color patches or patterns) to display 140, and then query measurement unit 130 pointed to an area of display 140 screen where a calibration test image is being displayed to determine what is actually displayed by display 140 in response to the output color calibration signals. Calibration system 100 may perform calibration based on actually measured color response display values identified by computer system 110 via measurement unit 130 as uncorrected output data from display 140. In one embodiment, the color response values detected by measurement unit 130 may be in a device-independent color space like CIELUV color space, CIEXYZ color space, CIE xyY color space, the CIE LAB color space, and the like.

In one embodiment, calibration system 100 controlling measurement unit 130 and display 140 may output solid color patches corresponding to a primary color channel (e.g., blue) with increasing digital count (e.g., 0-255 for blue with 255 representing the most saturated or maximum intensity blue). For example, calibration system 100 may successively output a 'ramp' from black to a most saturated blue for measurement by measurement unit 130. When measuring actual uncalibrated color response values via measurement unit 130 corresponding to the output color calibration 'ramp', computer system 110 may compensate for 'noise' in the measured values. For example, the 'noise' may include backlight leakage of panel 140. That is, when the color calibration image data is output to display 140, a certain amount of backlight leakage may get mixed in, thereby changing the corresponding measurement value (e.g., chromaticity value) measured by measurement unit 130 for a particular intensity of blue. To compensate for this 'noise', measurement unit 130 may offset all measurements by a pre-measured 'noise' value for the backlight leakage of the panel. Computer system 110 may control measurement unit 130 to measure the backlight leakage of display 140 in a device-independent color space (e.g., tristimulus values $XYZ_b$) when display 140 is set to a black state (e.g., digital count of output calibration image data for the primary color being measured is 0). Computer system 110 may then control measurement unit 130 to successively measure values corresponding to the output color calibration 'ramp' (e.g., digital count of output calibration data for the selected primary color being measured is 1, 2, 3, . . . 255) in a device-independent color space (e.g., tristimulus values $XYZ_m$). For each measured value $XYZ_m$, computer system 110 may then offset the measured value $XYZ_m$ by the measured backlight leakage $XYZ_b$, to obtain the exact chromaticity of the selected primary color digital count.

Based on the color response values measured by measurement unit 130 (and corrected to remove 'noise' by computer system 110), calibration pipeline 120 implemented by computer system 110 may perform one or more calibration operations to generate calibration information or data (e.g., RGB adjustment values in one or more lookup tables (LUTs)) 150 for later use by display 140 during normal operation. The calibration data may be used for color correction so that a standard color or image signal (e.g., D65 white) that is supplied to display 140 will be rendered more faithfully by accounting for the unique characteristics of display 140.

Figure 2:
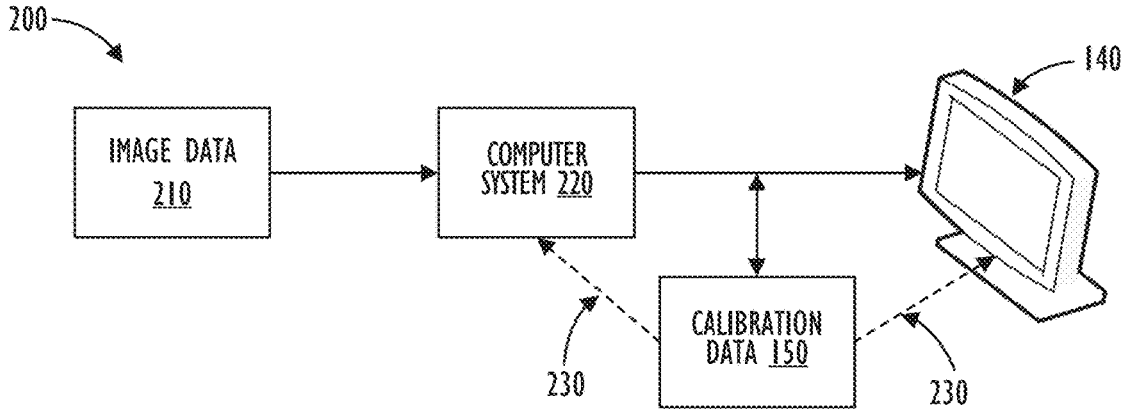
FIG. 2 is a block diagram depicting the operation of a calibrated display system, in accordance with one or more embodiments.

Referring now to FIG. 2, a block diagram depicting the operation of a calibrated display system 200 utilizing calibration data 150 in accordance with one or more embodiments, is illustrated. Uncorrected image data 210 may be provided to an image control unit, such as computer system 220 (including, e.g., CPU, ROM, RAM, hard disk, input-output devices, and the like), which in turn may provide a corrected image or video signal to display 140, as will be readily understood by those of ordinary skill in the art. The data utilized by computer system 220 to correct image data 210 may be provided by calibration data 150. Dotted arrows 230 between calibration data 150, computer system 220, and display 140, depict that calibration data 150 may be located in an on-board memory (e.g., TCON, EDID, or DisplayID) of display 140, in a storage device of computer system 220, and/or externally from either computer system 220 or display 140, as may be desired and appropriate for the particular configuration at hand.

Figure 3:
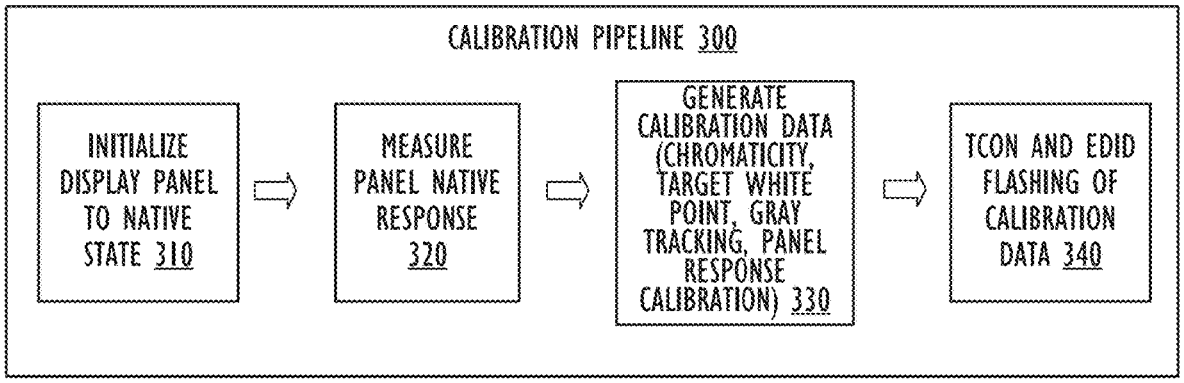
FIG. 3 illustrates a calibration pipeline for display device calibration, in accordance with one or more embodiments.

Referring now to FIG. 3, a typical calibration pipeline 300 for calibration of a display panel is illustrated. Calibration pipeline 300 may be implemented in a factory during manufacture of the display panel for achieving the best color performance of the display device and ensure correctness of a color model (e.g., RGB, CMYK, CIEXYZ, CIELUV, CIELAB, and the like) used in color management by the display device. Alternately, calibration pipeline 300 may be implemented on a computer system (e.g., computer system 110 of FIG. 1) and may utilize a measurement instrument (e.g., measurement unit 130 of FIG. 1) and corresponding calibration software on the computer system to perform post-factory calibration as an external on-demand calibration system based on user operation in the field. Color management may refer to controlled conversions between color models or color spaces of various devices so as to obtain a good color match across the color devices. This produces consistent color rendering across all display devices contributing to high color quality and faithful reproduction of colors as per a source content author's rendering intent.

As shown in FIG. 3, calibration pipeline 300 may include initializing the display panel to a native (uncorrected) state (block 310). That is, the display panel to be calibrated may be set in a native mode where no color corrections are applied to various color channels or primaries (e.g., RGB) of the display. Thus, at block 310, all color channels may be driven at full power. At block 320, the calibration system (e.g., calibration system 100 of FIG. 1) implementing color calibration pipeline 300 may measure a native response of the display panel. That is, the calibration system implementing pipeline 300 may measure 'native' chromaticities of RGB primaries of the display together with other parameters (e.g., native white point measurement). At block 320, the measured 'native' chromaticities of RGB primaries of the display may correspond to the maximum intensity (or maximum saturation) of the each color primary displayable by the display when no color corrections are being applied to output image data. Based on the native panel response measurement at block 320, calibration system 100 implementing pipeline 300 may perform various calibration operations including chromaticity, white point, gray tracking and panel response calibrations, and generate calibration information or data (block 330).

For example, at block 330, calibration system 100 may generate data (e.g., RGB adjustment values for the target white point in a LUT) that calibrates the display panel to a target white point (e.g., D65) from the native white point response of the display panel measured at block 310. A native white point of a display device may be defined as a color produced by the device when the device generates all colors at full power (e.g., without any correction or calibration applied). For example, when red, green, and blue channels (i.e., primary colors, colors, or simply, 'primaries') for a display device are all active at full power (e.g., maximum voltage applied from display driver to each of the red, green, and blue sub-pixels of the display pixel), the chromaticity values, for example, as measured in Cartesian coordinates x and y with respect to a chromaticity diagram, are the native white point of the display device. The white point may be defined by the pair of chromaticity values (x, y) as represented by x, y in the International Commission on Illumination (CIE) 1931 XYZ color space; or u', v' in the CIELUV color space; and the like. White points may vary among display devices due to inherent properties of the particular panel such that when the red, green, and blue channels for a first display device are all active at full power, the resulting (u', v') chromaticity value corresponding to the native white point of the first display device is different from the (u', v') chromaticity value corresponding to the native white point of another display device when the red, green, and blue channels for the other display device are also all active at full power.

This native or original (uncorrected) white point of the display device may be corrected in a white point calibration process to be adjusted to a target white point which is consistent across multiple display devices. For example, the target white point may correspond to the D65 illuminant of the International Commission on Illumination (CIE). In the white point calibration, each device may be tuned to the target white point by adjusting display control settings such as gain values for the red, green, and blue channels individually. Alternately, RGB adjustment values that produce the color (e.g., represented in a device-independent color space with target chromaticity coordinates ($u'_0$, $v'_0$)) corresponding to the target white point may be stored in a LUT as calibration data 150.

In addition to white point calibration, block 330 of calibration pipeline 300 may also include performing panel response calibration and gray tracking calibration and generating corresponding calibration or correction data. Panel response calibration performed at block 330 of calibration pipeline 300 is described below in connection with FIG. 4. Gamma adjustment, or, as it is often simply referred to, "gamma," is the name given to the nonlinear operation commonly used to encode luminance into digital values and decode digital values into luminance values in video or still image systems. Gamma, y, may be defined by the following simple power-law expression: $L_{out}=L_{in}Y$, where the input and output values, $L_{in}$ and $L_{out}$, respectively, are non-negative real values, typically in a predetermined range (e.g., zero to one). A gamma value greater than one is sometimes called an "encoding gamma," and the process of encoding with this compressive power-law nonlinearity is called "gamma compression;" conversely, a gamma value less than one is sometimes called a "decoding gamma," and the application of the expansive power-law nonlinearity is called "gamma expansion." Gamma encoding of content helps to map the content data into a more perceptually-uniform domain.

To perform panel response calibration, computer system 100 may control measurement unit 130 to measure the chromaticity coordinates and brightness of the display device while adjusting gray levels for each color channel (e.g., red, green, and blue channels) up to a maximum level. Computer system 100 may then generate calibration data (e.g., LUT) 150 to account for imperfections in the relationship between the encoding gamma and decoding gamma values, as well as the display's particular luminance response characteristics at different input levels.

Figure 4:
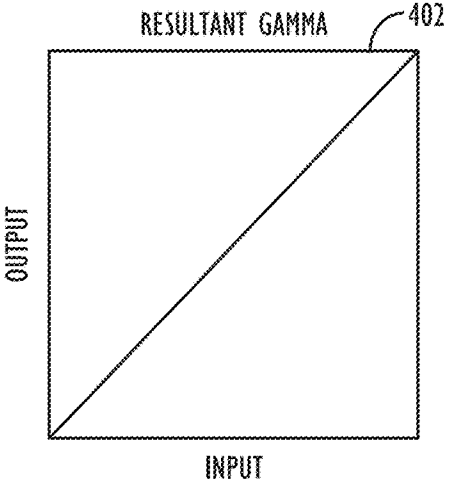
FIG. 4 illustrates a graph representative of a LUT transformation and a Resultant Gamma Function, in accordance with one or more embodiments.
Figure 4:
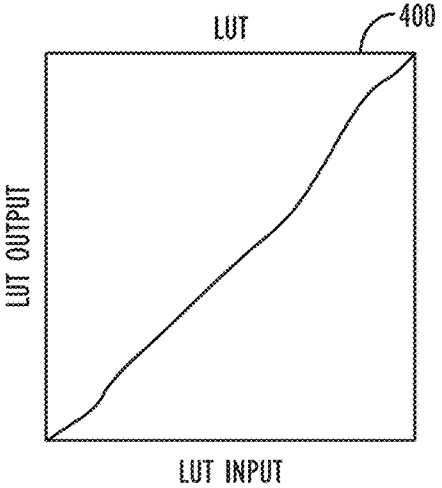

Referring now to FIG. 4, a graph representative of a LUT transformation 400 and a Resultant Gamma Function 402 are shown. The values measured by measurement unit 130 when performing panel response calibration may indicate a native or uncalibrated gamma, and uncalibrated curves of brightness versus gray levels for each color channel. LUT graph 400 may be determined based on the measured values to meet a target gamma for all color channels. The x-axis of LUT graph 400 represents input image values spanning a particular range (e.g., from zero to one). The y-axis of LUT graph 400 represents output image values spanning a particular range (e.g., from zero to one). Resultant Gamma Function 402 reflects a desired overall 1.0 gamma boost resulting from the gamma adjustment provided by the LUT.

The x-axis of Resultant Gamma Function 402 represents input image values as authored by the source content author spanning a particular range (e.g., from zero to one). The y-axis of Resultant Gamma Function 402 represents output image values displayed on the resultant display spanning a particular range (e.g., from zero to one). The slope of 1.0, reflected in the line in graph 402, indicates that luminance levels intended by the source content author will be reproduced at corresponding luminance levels on the ultimate display device.

In addition to accounting for panel response calibration (e.g., gamma calibration), LUT graph 400 (and calibration data 150) may also be generated at block 330 of calibration pipeline 300 so as to account for the gray tracking calibration to faithfully reproduce the full range of gray levels from black to white on the display device so that the shades of gray (e.g., linear range of R=G=B from 0 to 1) at different luminance levels will all appear to have the same neutral hue (e.g., same chromaticity (u', v')) for a given target white point. Gray tracking calibration evaluates and corrects for non-linearities in each color channel for each gray step for both hue and brightness. For example, computer system 110 may control measurement unit 130 to actually measure from display 140, colorimetric response display values of uncorrected digital values at suitable points of gray intensity levels output to display 140. Computer system 110 implementing calibration pipeline 300 may then analyze the measured colorimetric response values (actual pixel response) to determine how they deviate from 'ideal' values and to generate adjustment values that produce the true ('Ideal') gray levels with the display device for the associated target white point. Computer system 110 implementing calibration pipeline 300 may also accurately interpolate all values of interest for the associated target white point based on the actual measurements at the suitable points of gray intensity levels to generate the adjustment values for all gray levels for hue and brightness for the associated target white point. Computer system 110 implementing calibration pipeline 300 may thus generate calibration data 150 for gray tracking calibration based on the generated adjustment values which are in turn based on the actually measured colorimetric response display values or interpolated adjustment values. The generated calibration data 150 may then be used to calibrate the red, green, and blue channels of the display device to produce true gray levels with the same neutral hue and corresponding brightness for all gray intensity levels from black to the target white point.

The pixel (e.g., digital values for RGB) adjustment values for gray tracking may be stored in the same LUT as the LUT for gamma correction (and/or white point correction) or may be stored in a different LUT for gray tracking correction. Each LUT may include, for example, a LUT for red values between 0 and 255, a LUT for green values between 0 and 255, and a LUT for blue values between 0 and 255. The LUTs for red, green, and blue values may be independent of each other and provide respective adjustment values for red, green, and blue independently for each of red, green, and blue color. Alternately, each LUT may be a 3D LUT in which respective adjustment values for red, green, and blue are interdependent. Calibration data 150 may thus include data generated to correct for each of gray tracking, white point, and panel response calibration.

Returning to FIG. 3, the one or more calibration operations performed by calibration pipeline 300 may also include chromaticity calibration. In one embodiment, as part of the chromaticity calibration, calibration system 100 implementing calibration pipeline 300 may measure 'native' RGB chromaticities for a plurality of display panels being calibrated (e.g., batch of panels being manufactured and factory calibrated), obtain an average chromaticity for each of the red, green, and blue primaries, and store the average RGB chromaticities in the EDID (or DisplayID) portion of the TCON of each panel. In an alternate embodiment, in performing chromaticity calibration, calibration system 100 implementing calibration pipeline 300 may measure 'native' RGB chromaticities for a particular display panel being calibrated, and store the measured (panel-specific) 'native' RGB chromaticities in the EDID or DisplayID portion of the TCON of the particular panel. At block 340 of calibration pipeline 300, calibration data 150 together with the RGB primary measurements (e.g., native or uncorrected values for RGB chromaticity coordinates measured at block 320 or average chromaticity values for a batch of panels) may then be flashed into the TCON and EDID or DisplayID of the display panel. More specifically, the calibration data 150 may be stored in the TCON of the panel, and the (native or average) RGB primary chromaticity values may be flashed as the EDID or DisplayID data of the TCON.

When the display device is then connected to a computer system (e.g., computer system 220 in FIG. 2), the OS may detect the EDID (or DisplayID) of the display and automatically build an ICC profile. The ICC profile is a set of data that characterizes a color output device, or a color space, according to standards promulgated by the International Color Consortium (ICC). ICC profiles may describe the color attributes of a particular device or viewing requirement by defining a mapping between the device color space and a profile connection space (PCS). ICC profiles may be used to define a color space mapping generically in terms of three main pieces: 1) the color primaries that define the gamut; 2) the transfer function (sometimes referred to as the gamma function); and 3) the white point. The ICC profile may be used by an integrated Color Management System of the OS to accurately transform any RGB system color into an RGB display color within the display color gamut that is displayable on the display device (e.g., display 140).

As described above, the ICC profile generated for the display that is calibrated based on calibration pipeline 300 takes into account the RGB chromaticity values measured at block 320 (or average values for a batch of panels determined in the chromaticity calibration) and flashed into the EDID (or DisplayID) of the display panel. However, the primary chromaticities measured at block 320 of pipeline 300 correspond to 'native' (e.g., uncorrected or un-calibrated) primaries (or 'average' primaries) of the display measured by the measurement instrument. Further, the calibration data generated at block 330 in response to the one or more calibration operations (e.g., white point calibration, gray tracking calibration, panel response calibration) may create calibration constraints for the display such that the display is no longer able to achieve the 'native' primary chromaticities (or 'average' chromaticities) when it operates in the calibrated state. For example, RGB adjustment values generated as part of calibration data at block 330 in response to white point calibration may change the balance between red, green, and blue channels to achieve a target white point (e.g., D65) by truncating, for example, two of the three channels so that they no longer can reach the maximum 'native' saturation (native maximum intensity). As a result, for example, the blue primary may no longer be able to reach its original full blue intensity (e.g., saturation). In this example, this may result in a difference between the 'native' blue maximum intensity and the maximum intensity of blue that is achievable after the white point calibration. This also results in different chromaticity values for the 'native' blue and the blue in the calibrated state.

As described above, in calibration pipeline 300, since the 'native' (or 'average') primary chromaticities are flashed in the EDID (or DisplayID) of the display and used in creating the ICC profile of the panel, the panel may end up advertising primary chromaticity values that it cannot actually produce when operating in the calibrated state (e.g., during operation as shown in FIG. 2). In other words, due to the one or more calibration operations, a discrepancy may exist between: (i) chromaticities of primary colors that a display advertises (e.g., in the EDID, or DisplayID) as being capable of reproducing, and (ii) chromaticities actually reproducible by the display (e.g., after calibration). This discrepancy introduces a source of error that breaks the accuracy of the correspondence between the physical behavior of the calibrated panel and its ICC profile that is supposed to model this behavior. Thus, even if calibration system 100 implementing calibration pipeline 300 is used by a user to self-calibrate (re-calibrate) the panel 140 in the field (e.g., post-factory calibration), the above described discrepancy may persist in the on-board memory (e.g., TCON, EDID) of display 140, and thus, in the ICC profile, and translate into an inaccurate color rendition on the screen. This source of error is described in greater detail below in connection with FIGS. 5 and 6.

Figure 5:
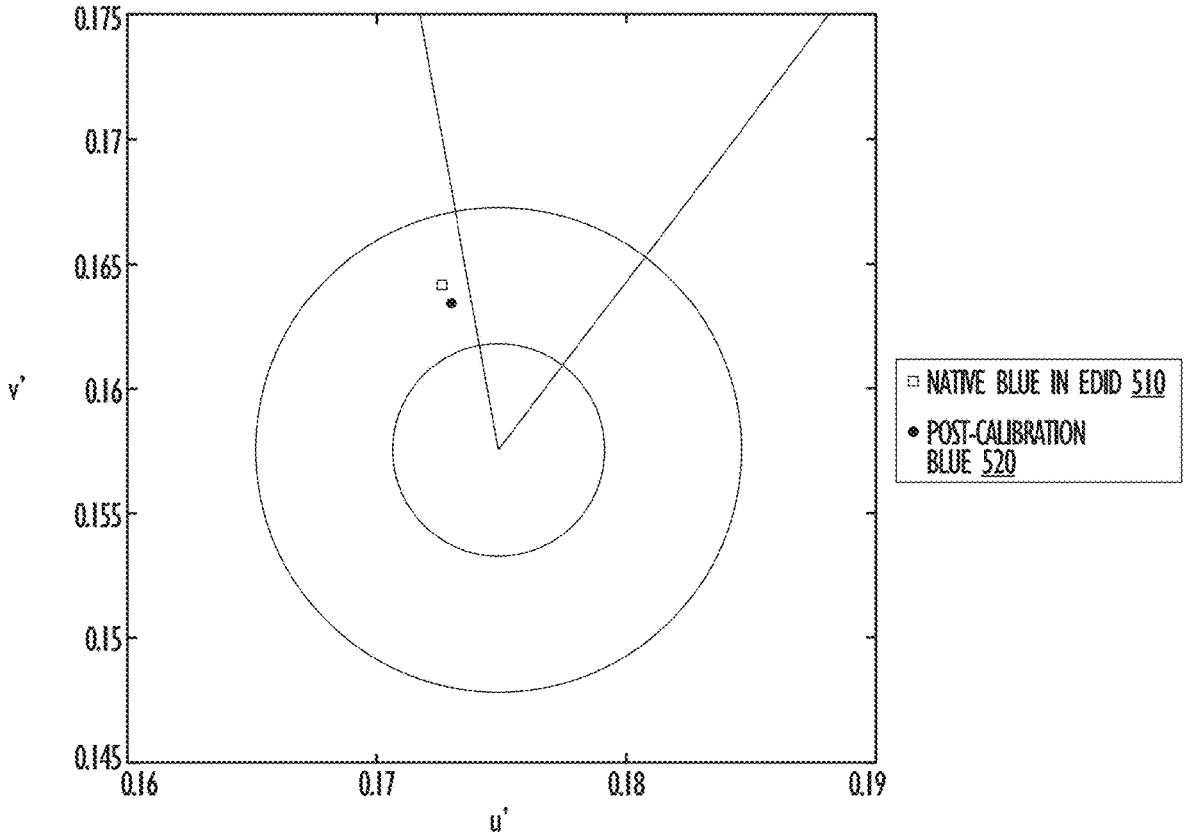
FIG. 5 shows a graph illustrating a comparison between a measured native chromaticity value of a primary color reported in an Extended Display Identification Data (EDID) of a display device and a measured chromaticity value of the primary color after calibration with the calibration pipeline shown in FIG. 3.

FIG. 5 shows a graph illustrating a difference between a plot of a measured native (or average) chromaticity value for blue 510 reported in the EDID (or DisplayID) of a display that has been calibrated by a calibration system implementing calibration pipeline 300 and a plot of a blue chromaticity value 520 measured while driving the display under the calibration constraints dictated by the generated calibration data of calibration pipeline 300. Although FIG. 5 shows (u', v') chromaticity or color values in the CIELUV color space independent of luminance, similar information can also be represented in other color spaces (e.g., CIEXYZ color space). As shown in FIG. 5, there is a significant difference between the native (u', v') chromaticity value 510 that corresponds to the blue color at full 'native' intensity (e.g., maximum native saturation) and that is flashed in the EDID of the display, and the post-calibration (u', v') chromaticity value 520 that corresponds to the blue color at full 'post-calibration' intensity (e.g., maximum possible post-calibration saturation) and that is measured under the calibration constraints imposed by the calibration data associated with the display. This difference (between 510 and 520) is a source of error that translates into an inaccurate color rendition on the screen. FIG. 5 discusses the chromaticity value inaccuracy with respect to the blue primary only for illustrative purposes. Similar differences between 'advertised' and 'actual' primary chromaticity values may also persist in other color channels (e.g., green, red) when calibration is performed with a calibration system implementing calibration pipeline 300.

Figure 6:
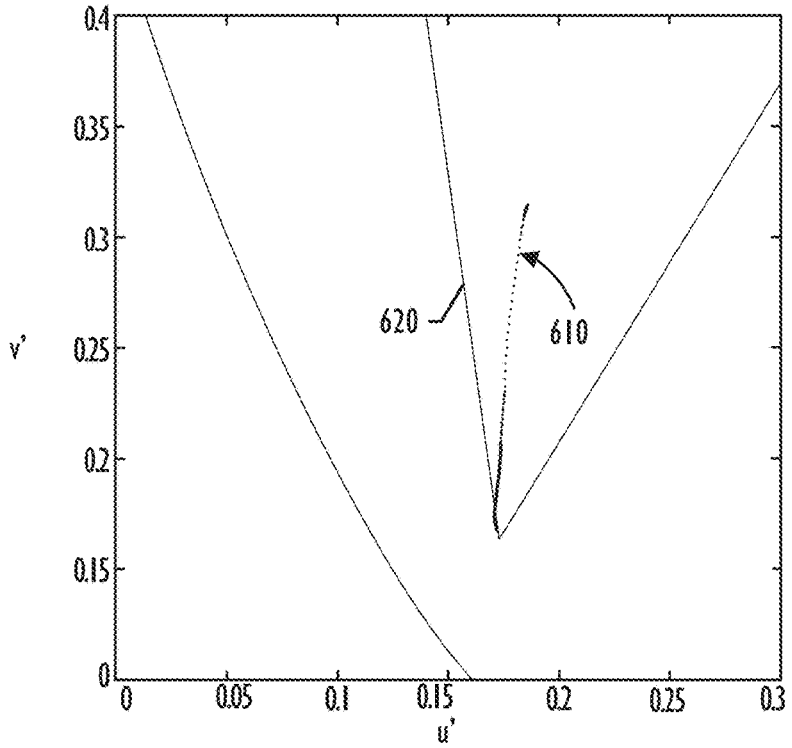
FIG. 6 shows a graph illustrating a plot of measurements of chromaticity values of a primary color for different intensity levels.

Another disadvantage of allowing differences between 'advertised' and 'actual' primary chromaticities to persist in calibration data (and thus, in the EDID) is decreased yield during the calibration process due to increased panel rejections based on calibration failures. FIG. 6 illustrates plot of measurements 610 of (u', v') chromaticity values for the blue primary measured by a measurement unit of a calibration system implementing calibration pipeline 300. For example, the calibration system implementing calibration pipeline 300 may output (native or uncorrected) color calibration signals corresponding to a 'ramp' from black to a most saturated native blue on a display being calibrated. The calibration system implementing calibration pipeline 300 may then control a measurement unit to detect chromaticity values that respectively correspond to the output native or uncorrected calibration image data on the display at intensity levels or steps from black to a most saturated blue. The measured chromaticity values may correspond to plot of measurements 610 of (u', v') chromaticity values shown in FIG. 6. Ideally, in the output native or uncorrected calibration image data on the display, since only the intensity level is changing for each step, the corresponding point of (u', v') chromaticity value measured by the measurement unit should stay the same. That is, instead of being a line, plot of measurements 610 in FIG. 6 should be measured as a single (u', v') chromaticity point on the graph. However, due to unique characteristics of the display being calibrated (e.g., color filter thickness, backlight variations, and the like), the (u', v') chromaticity value may change for changing intensity levels or steps.

Further, due to the unique characteristics of the display being calibrated, as illustrated in FIG. 6, plot of measurements 610 may show a curvature to the outside of the native RGB chromaticity triangle 620 (e.g., native color gamut of display). When a panel having measurement response characteristics illustrated by plot of measurements 610 shown in FIG. 6 is calibrated by a calibration system implementing calibration pipeline 300, the panel may fail the calibration and may get rejected due to the excessively abnormal response characteristics measured by the measurement unit.

A hardware solution to the problems described above in connection with FIGS. 3, 5, and 6 involves changing the backlight design of the panel in the factory during manufacture so that the calibration operations do not require any change to the balance between red, green, and blue primaries, thereby ensuring that even under the calibration constraints, each channel is able to reach its maximum 'native' saturation or intensity. Another solution to the above described problem involves imposing strict quality control requirements in the factory during manufacture so that only those panels that are able to achieve their native chromaticities after the calibration constraints are imposed are allowed to pass the verification process.

Figure 7:
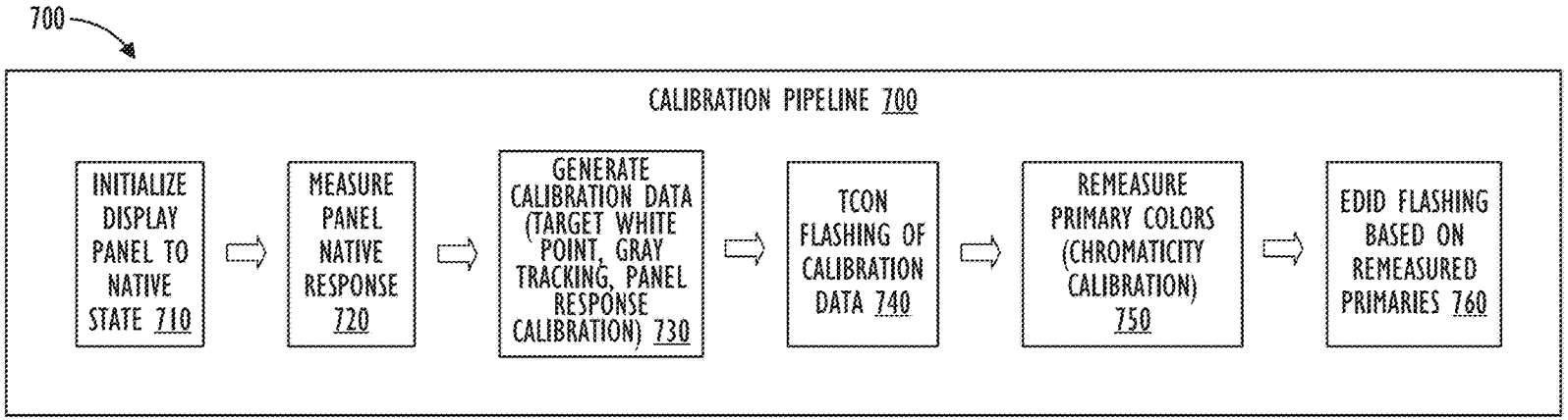
FIG. 7 illustrates another embodiment of a calibration pipeline for display device calibration.
Figure 8:
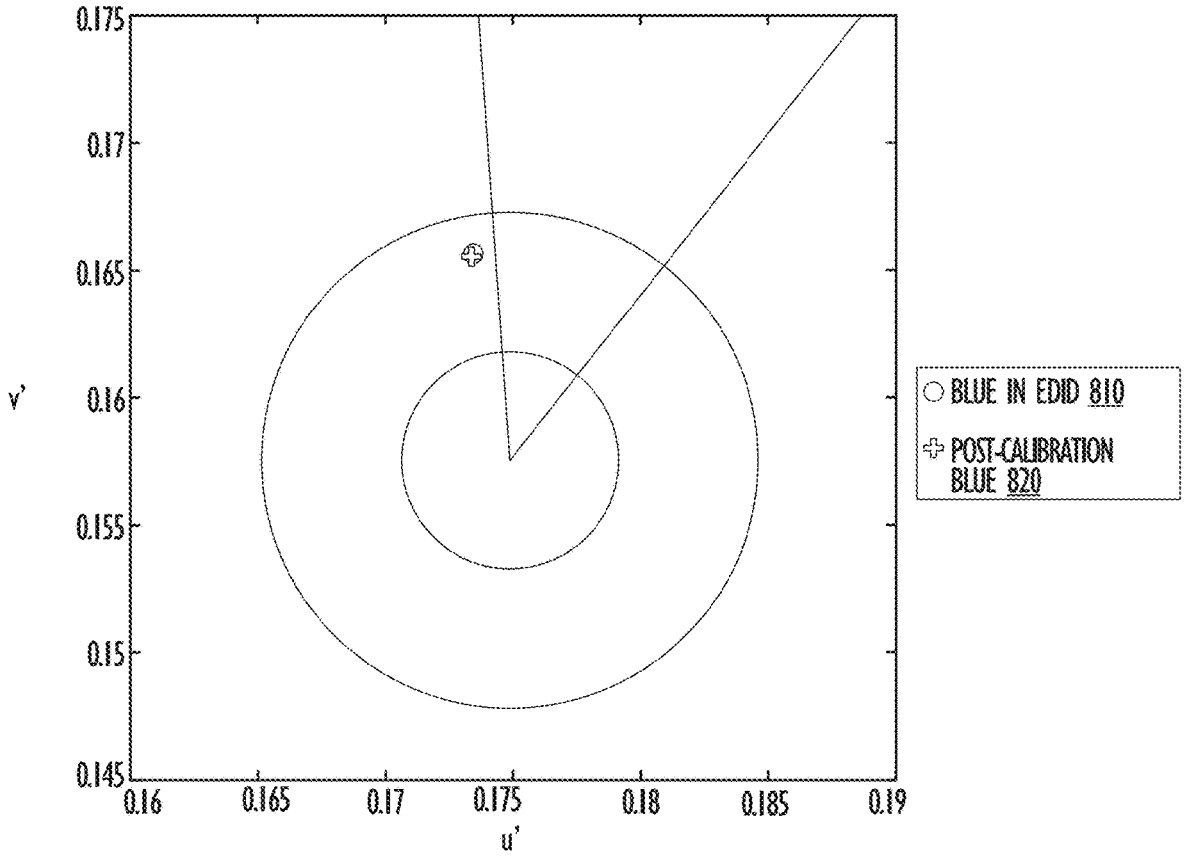
FIG. 8 shows a graph illustrating a comparison between a chromaticity value of a primary color reported in the EDID of a display device and a measured chromaticity value of the primary color after calibration with the calibration pipeline shown in FIG. 7.

Another solution to address the problems described above in connection with FIGS. 3, 5, and 6 involves changes to the calibration pipeline, as illustrated in FIGS. 7 and 8. This solution can be applied to existing panels in post-factory calibration to eliminate differences between primary chromaticities advertised by the panel, and chromaticities the panel can actually achieve post-calibration, with the calibration constraints enforced. As shown in FIG. 7, this solution involves modifying the calibration pipeline to flash (e.g., record, store) calibration information twice into the on-board memory of the display (e.g., first flash gray tracking, white point, and panel response calibration data into the TCON of the display, and then, remeasure RGB chromaticities in the calibrated state and flash the remeasured chromaticity values into the EDID (or DisplayID) portion of the TCON of the display).

FIG. 7 illustrates calibration pipeline 700 for calibration of a display device, in accordance with one or more embodiments. Calibration pipeline 700 may be implemented in a factory during manufacture of the display panel. Alternately, calibration pipeline 700 may also be implemented on an external calibration system (e.g., computer system 110 of FIG. 1) and may utilize a measurement instrument (e.g., measurement unit 130 of FIG. 1) and corresponding calibration software on the computer system so that customers can perform on-demand self-calibration of the display by connecting the external calibration system to a system of the display.

In FIG. 7, operations performed at blocks 710 and 720 of calibration pipeline 700 may be similar to those performed at blocks 310 and 320 of calibration pipeline 300. More specifically, as shown in FIG. 7, calibration pipeline 700 may also include initializing the display panel to a native (uncorrected) state (block 710) where no color corrections are applied to various color channels of the display panel. Thus, at block 710, all color channels may be driven at full 'native' power (e.g., maximum or native intensity without any corrections being applied). When calibration pipeline 700 is implemented as a post-factory calibration pipeline, the operation at block 710 to initialize the panel to the native state may involve 'bypassing' the (previously generated and stored) calibration data stored in the TCON, EDID, or DisplayID of the display panel being (re-)calibrated. By bypassing any corrections being applied to image data output to the display panel based on the previous calibration information stored in TCON, EDID, or DisplayID, the panel is driven in its 'native' or uncorrected state, thus revealing the native response of the panel to output image data. Thus, at block 710, the computer system implementing calibration pipeline 700 may control the display being calibrated so that display input buffers are directly connected to display output buffers (e.g., calibration pipeline is a 'straight-line') and no corrections are applied to output calibration image signals.

At block 720, the calibration system (e.g., calibration system 100 of FIG. 1) implementing color calibration pipeline 700 may measure the native response of the display panel. For example, at block 720, the calibration system implementing pipeline 700 may measure the 'native' chromaticity values of RGB primaries of the display together with other parameters (e.g., native white point measurement). Since no corrections are being applied to calibration image data being displayed on the display, the calibration system implementing pipeline 700 can accurately measure the native response (e.g., maximum displayable intensity or saturation of each color channel in its native state) of the panel in response to output calibration image data. For example, at block 720, the computer system implementing calibration pipeline 700 may output test and calibration image or video color calibration signals to the display being calibrated, and then query a measurement instrument to determine what is actually displayed by the display in response to the output color calibration signals.

Based on the native panel ('bypass') response measurement at block 720, the calibration system implementing pipeline 700 may perform various calibration operations including white point, gray tracking and panel response calibrations, and generate calibration information or data (block 730). Details of white point, gray tracking, and panel response calibrations that may be performed at block 730 have been explained above in connection with FIG. 3, and detailed description thereof is omitted here. As explained previously, calibration data that is generated at block 730 and that corrects for a target white point, and suitable gray tracking and panel response calibrations may be in the form of RGB adjustment values that are stored as tables or numeric values in one or more LUTs. At block 740 of calibration pipeline 700, the calibration data generated at block 730 may be flashed into the TCON (or other suitable on-board memory or chip) of the display panel. In case calibration pipeline 700 is implemented as a post-factory calibration pipeline, the operation at block 740 may involve updating previously generated calibration data stored in the TCON of the display panel with the new calibration data generated at block 740. That is, the operation at block 740 may update (e.g., wipe-out, or re-write) the previous calibration data that was bypassed at block 710 to initialize the panel to its native state. At, at block 740, the computer system implementing calibration pipeline 700 does not store into the EDID or DisplayID the 'native' RGB chromaticity values measured at block 720 (since they may no longer be acheiveable based on the new calibration data).

At block 750, the calibration system implementing calibration pipeline 700 remeasures the RGB chromaticity values while driving the display based on calibration data generated at block 730 and flashed (e.g., stored, recorded) into the TCON at block 740, so as to perform chromaticity calibration. As explained previously, the calibration data that corrects for the gray tracking, white point, and panel response calibration may cause to may create calibration constraints for the display such that the display is no longer able to achieve the 'native' primary chromaticities when it operates in the calibrated state. To account for these calibration constraints, the calibration system implementing calibration pipeline 700 at block 750 remeasures the RGB chromaticity values that the display can actually reproduce under the calibration constraints imposed by the one or more calibration operations and corresponding data generated at block 740. That is, at block 750, the remeasured chromaticity values of RGB primaries of the display may correspond to a maximum intensity (or maximum saturation) for the each color primary displayable by the display when color corrections are being applied to output image data based on the calibration data generated at block 730 and stored in the TCON at block 740. Thus, while driving the display in a calibrated state, the maximum intensity of the RGB chromaticity values of the display panel are measured by the measurement instrument. At block 760, the calibration system implementing calibration pipeline 700 records the remeasured primary color chromaticity values as calibration information in the EDID or DisplayID of the display being calibrated. That is, the remeasured primary color chromaticity values are stored as EDID data or DisplayID data in the TCON of the display panel.

As explained above, the remeasuring (block 750) and recording (block 760) of the primary color values (RGB chromaticity values) is performed by the calibration system implementing calibration pipeline 700 after flashing in the TCON of the gray tracking, white point and panel response calibration data (block 740). This is because the panel may no longer reach the similar maximum color values that were measured in the native state (block 720) after the gray tracking, gamma and white point calibration are flashed into the TCON (block 740). In a calibrated display unit, the maximum digital count for a channel cannot take a value higher than that of the value stored in the calibration data (e.g., gamma-LUT for that channel) in the TCON that was calculated and flashed at the time of calibration. Consequently, referring to the example of blue primary calibration previously illustrated in FIG. 5, in the calibrated state for the maximum digital count on the blue channel, the native blue of the panel is no longer reached and because of that, the blue primary after the calibration may be slightly different from the blue primary before the calibration. By storing as the primary chromaticity values in the EDID, the chromaticity value that can be reached under the TCON digital count constraints, the above described primary color discrepancy is resolved by the calibration system implementing calibration pipeline 700. Thus, the calibration system implementing calibration pipeline 700 flashes in the EDID the primary chromaticity values that correspond exactly to the response of the calibrated panel. This ensures that the ICC profile will correspond to the calibrated panel state, and this will enable the color management operations to correspond accurately to the response of the panel modeled by the ICC profile.

FIG. 8 shows a graph illustrating a comparison between a plot of a chromaticity value 810 for blue reported in the EDID (or DisplayID) of a display device that has been calibrated by a calibration system implementing calibration pipeline 700 of FIG. 7, and a plot of a blue chromaticity value 820 measured while driving the display under the calibration constraints dictated by the generated calibration data of calibration pipeline 700. Similar to FIG. 5, the graph in FIG. 8 also shows (u', v') chromaticity or color values in the CIELUV color space independent of luminance. As shown in FIG. 8, there is no difference between the (u', v') chromaticity value 810 that corresponds to the blue color and that is flashed in the EDID of the display, and the post-calibration (u', v') chromaticity value 820 that corresponds to the blue color at full 'post-calibration' intensity (e.g., maximum possible post-calibration saturation) and that is measured under the calibration constraints imposed by the calibration data associated with the display. That is, as shown in FIG. 8, plot of the two measurements 810 and 820 overlap. As is evident from the graph illustrated in FIG. 8, the calibration system implementing calibration pipeline 700 eliminates error in blue primary calibration, thereby translating into an accurate color rendition on the screen. FIG. 8 describes the elimination of error with respect to the blue primary for illustration only. Similar advantages can also be produced by implementing calibration pipeline 700 with respect to other color channels (e.g., green, red).

Figure 9:
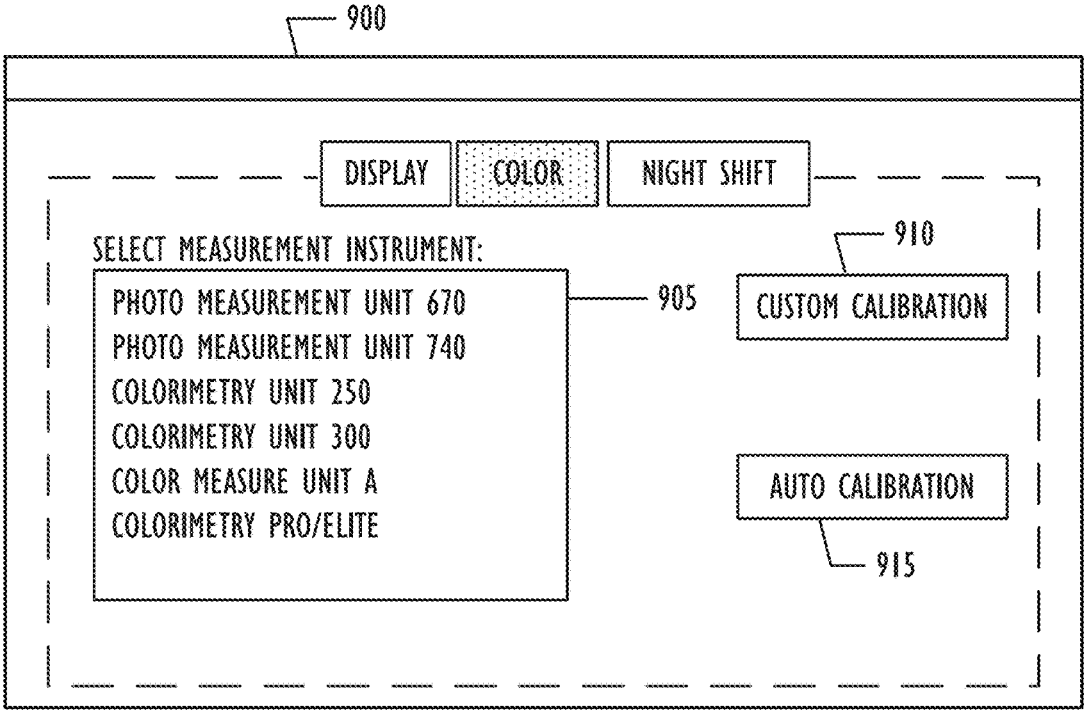
FIG. 9 illustrates a user interface for performing post-factory calibration on a display device, in accordance with one or more embodiments.

FIG. 9 illustrates exemplary user interface 900 for performing post-factory calibration on a display device, in accordance with one or more embodiments. Using FIG. 7 as an example, a user may be able to utilize a computer system implementing calibration pipeline 700 and user interface 900 to calibrate a display in the field (post-factory calibration). As shown in FIG. 9, user interface 900 includes window 905 that lists different measurement instruments a user may select from to perform calibration of a display connected to the calibration system implementing calibration pipeline 700. Window 905 may include different measurement instruments that are compatible with the display device being calibrated and/or that the user has previously used to calibrate a display on the calibration system. The calibration system implementing user interface 900 may measure the native response of a display connected to the calibration system and calibrate the display using the measurement instrument selected by the user at window 905. User interface 900 may also include a variety of options, such as the "custom calibration" option 910, and "auto calibration" option 915 that allow a user to perform a custom calibration based on custom input settings for the display, or perform an automatic calibration of the display. For example, the "custom calibration" option 910 may allow the user to selectively perform one or more of the chromaticity calibration, panel response calibration, gray tracking calibration, white point calibration, luminance calibration, and the like, and provide custom setting for each calibration operation. While the "auto calibration" option 915 may perform all calibration operations automatically, without any additional input from the user. User interface 900 may thus be configured to receive an indication from the user to calibrate a display panel connected to the calibration system implementing implementing user interface 900 and corresponding calibration pipeline 700, and calibrate the panel based on selected measurement instrument. Based on the calibration indication (e.g., user operating "auto calibration" option 915), one or more steps of calibration pipeline 700 may be executed, and TCON, EDID, or DisplayID of the display may be updated.

The calibration method described herein produces several advantages. First, the method improves color accuracy of the calibration and causes the ICC profile to match exactly the response of the calibrated panel. Second, the method eliminates the color error produced by the conventional color calibration, and also increases significantly the accuracy of the color management system relative to the reproduction of color on the calibrated display. Third, when the method is employed as part of factory calibration, the percentage of rejected units as being 'out-of-spec' during the validation process at the factory calibration line are considerably reduced, thereby resulting in a higher yield of the factory line. Fourth, the method is able to calibrate and qualify a larger variety of panels with abnormal responses because the method is able to correct for the abnormal panel response. For example, a conventional calibration method may lead to a rejection of a panel with a response as illustrated in FIG. 5 where the chromaticity locus of a blue ramp measurement lies on a curve shape outside of the color gamut of the device. Despite this behavior, the calibration method described herein may be able to correctly calibrate a panel with such a native response so that after the calibration, the panel performs correctly within tolerance limits.

Figure 10:
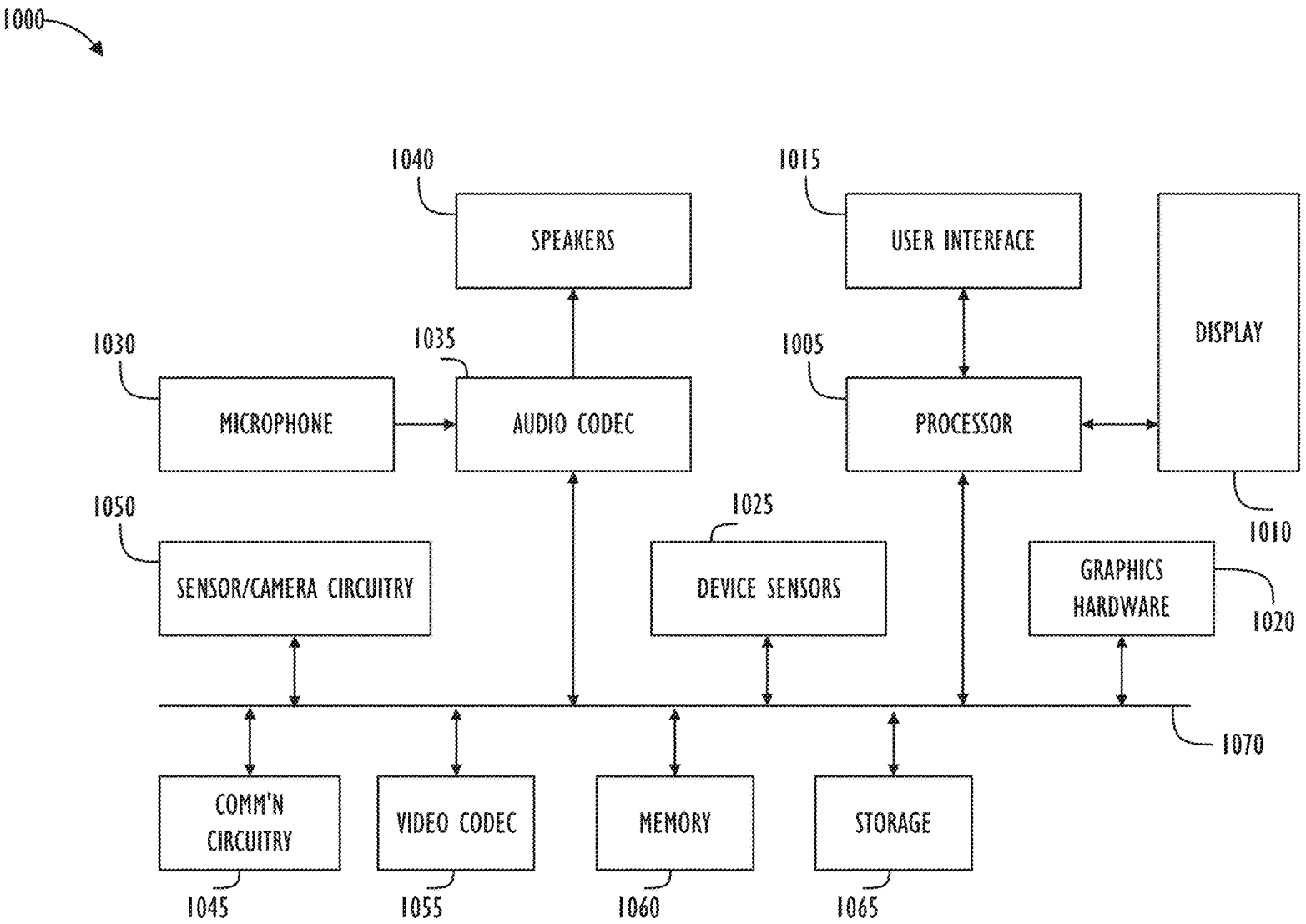
FIG. 10 is a simplified functional block diagram of an illustrative multi-functional electronic device, in accordance with one or more embodiments.

Referring to FIG. 10, a simplified functional block diagram of illustrative device 1000 (e.g., computer system 110 of FIG. 1, computer system 220 of FIG. 2, calibration system implementing calibration pipelines 300 and 700 of FIGS. 3 and 7, and the like) that performs calibration operations as described in FIGS. 1-9 is shown. Device 1000 may include processor 1005, display 1010 (e.g., display 140 of FIG. 1, and the like), user interface 1015, graphics hardware 1020, device sensors 1025 (e.g., proximity sensor/ambient light sensor, accelerometer, depth sensor, lidar, laser, IR, and/or gyroscope), microphone 1030, audio codec(s) 1035, speaker (s) 1040, communications circuitry 1045, sensor and camera circuitry 1050, video codec(s) 1055, memory 1060, storage 1065, and communications bus 1070. Electronic device 1000 may be, for example, a digital camera, a personal digital assistant (PDA), personal music player, mobile telephone, server, notebook, laptop, desktop, or tablet computer. More particularly, the disclosed techniques may be executed on a device that includes some or all of the components of device 1000.

Processor 1005 may execute instructions necessary to carry out or control the operation of many functions performed by a multi-functional electronic device 1000 (e.g., such as one or more calibration operations of a calibration pipeline and the like). Processor 1005 may, for instance, drive display 1010 and receive user input from user interface 1015. User interface 1015 can take a variety of forms, such as a button, keypad, dial, a click wheel, keyboard, display screen and/or a touch screen. Processor 1005 may be a system-on-chip such as those found in mobile devices and include a dedicated graphics-processing unit (GPU). Processor 1005 may represent multiple central processing units (CPUs) and may be based on reduced instruction-set computer (RISC) or complex instruction-set computer (CISC) architectures or any other suitable architecture and each may include one or more processing cores. Graphics hardware 1020 may be special purpose computational hardware for processing graphics and/or assisting processor 1005 process graphics information. In one embodiment, graphics hardware 1020 may include one or more programmable graphics-processing unit (GPU), where each such unit has multiple cores.

Sensor and camera circuitry 1050 may capture still and video images that may be processed to generate images in accordance with this disclosure. Sensor in sensor and camera circuitry 1050 may capture raw image data as red, green, and blue (RGB) data that is processed to generate an image. Output from camera circuitry 1050 may be processed, at least in part, by video codec(s) 1055 and/or processor 1005 and/or graphics hardware 1020, and/or a dedicated image-processing unit incorporated within camera circuitry 1050. Images so captured may be stored in memory 1060 and/or storage 1065. Memory 1060 may include one or more different types of media used by processor 1005, graphics hardware 1020, and camera circuitry 1050 to perform device functions. For example, memory 1060 may include memory cache, read-only memory (ROM), and/or random access memory (RAM).

Storage 1065 may store media (e.g., audio, image and video files), computer program instructions or software, preference information, device profile information, and any other suitable data. Storage 1065 may include one more non-transitory storage mediums including, for example, magnetic disks (fixed, floppy, and removable) and tape, optical media such as compact disc-ROMs (CD-ROMs) and digital video disks (DVDs), and semiconductor memory devices such as Electrically Programmable Read-Only Memory (EPROM), and Electrically Erasable Programmable Read-Only Memory (EEPROM). Memory 1060 and storage 1065 may be used to retain computer program instructions or code organized into one or more modules and written in any desired computer programming language. When executed by, for example, processor 805 such computer program code may implement one or more of the methods described herein.

Figure 11:
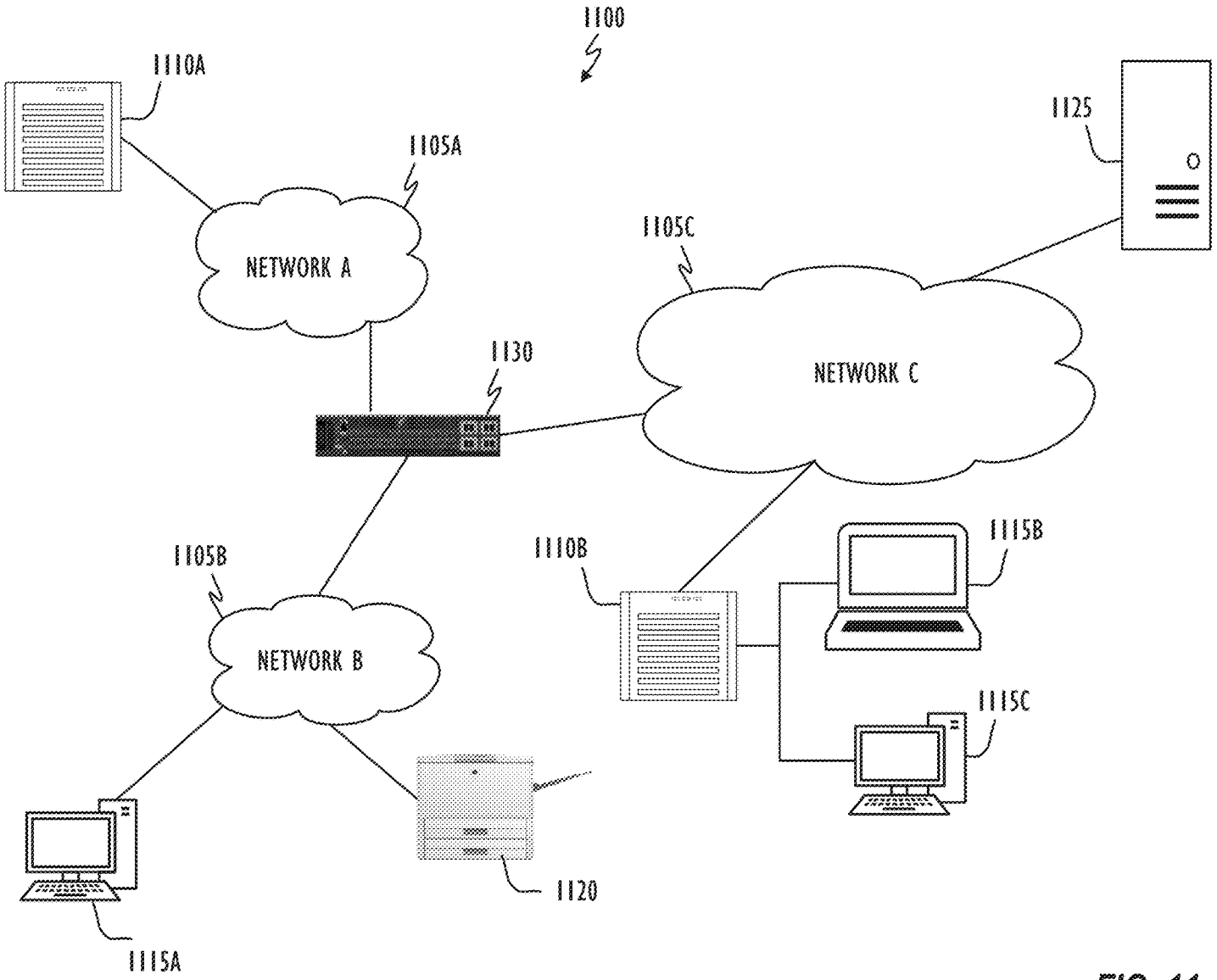
FIG. 11 shows, in block diagram form, a computer network, in accordance with one or more embodiments.

Referring to FIG. 11, illustrative network architecture 1100 within which a system for performing display calibration in accordance with the disclosed techniques may be implemented includes a plurality of networks 1105, (e.g., 1105A, 1105B and 1105C), each of which may take any form including, but not limited to, a local area network (LAN) or a wide area network (WAN) such as the Internet. Further, networks 1105 may use any desired technology (wired, wireless or a combination thereof) and communication protocol (e.g., TCP, or transmission control protocol and PPP, or point to point). Coupled to networks 1105 are data server computer systems 1110 (e.g., 1110A and 1110B) that are capable of communicating over networks 1105. Also coupled to networks 1105, and/or data server computer systems 1110, are client or end-user computer systems 1115 (e.g., 1115A, 1115B and 1115C). Each of these elements or components may be a computer system or electronic device as described above with respect to FIGS. 1-9. In some embodiments, network architecture 1100 may also include network printers such as printer 1120 and network storage systems such as 1125. To facilitate communication between different network devices (e.g., server computer systems 1110, client computer systems 1115, network printer 1120 and storage system 1125), at least one gateway or router 1130 may be optionally coupled there between.

As used herein, the term "computer system" or "computing system" refers to a single electronic computing device or to two or more electronic devices working together to perform the function described as being performed on or by the computing system. This includes, by way of example, a single laptop, host computer system, wearable electronic device, and/or mobile device (e.g., smartphone, tablet, and/or other smart device).

It is to be understood that the above description is intended to be illustrative, and not restrictive. The material has been presented to enable any person skilled in the art to make and use the claimed subject matter as described herein, and is provided in the context of particular embodiments, variations of which will be readily apparent to those skilled in the art (e.g., some of the disclosed embodiments may be used in combination with each other). In addition, some of the described operations may have their individual steps performed in an order different from, or in conjunction with other steps, than presented herein. More generally, if there is hardware support some operations described in conjunction with FIGS. 1-9 may be performed in parallel.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means±10% of the subsequent number, unless otherwise stated.

Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A display calibration method, comprising:

initializing a display panel to a native state;

measuring a native response of the display panel for each of a plurality of primary color chromaticity values;

performing one or more calibration operations for the display panel based on the measured native response;

generating calibration data for the display panel based on the one or more calibration operations;

storing the generated calibration data in an on-board memory of the display panel;

remeasuring each of the plurality of primary color chromaticity values of the display panel while driving the display panel in a calibrated state based on the generated calibration data;

determining a discrepancy between the remeasured plurality of primary color chromaticity values and a plurality of advertised primary color chromaticity values for the display panel, wherein determining a discrepancy further comprises, for at least one primary color, determining that at least one of the remeasured chromaticity values for the at least one primary color fall to the outside of a native chromaticity triangle of the display panel;

storing, in response to determining a discrepancy, the remeasured plurality of primary color chromaticity values of the display panel in the on-board memory; and updating the generated calibration data based on the remeasured plurality of primary color chromaticity values.

2. The display calibration method according to claim 1, further comprising receiving an indication to calibrate the display panel from a user, wherein the display panel is initialized to the native state, and the native response of the display panel is measured in response to receiving the indication to calibrate the display panel.

3. The display calibration method according to claim 2, wherein the indication to calibrate the display panel is received from the user via a user interface of a calibration system implementing the display calibration method and connected to a system of the display panel, and wherein the method further comprises:

receiving via the user interface an indication of a measurement instrument to be used for measuring the native response of the display panel.

4. The display calibration method according to claim 2, wherein initializing the display panel to the native state comprises bypassing previous calibration data stored in the on-board memory of the display panel so as to drive the display panel without any corrections being applied based on the previous calibration data.

5. The display calibration method according to claim 4, wherein storing the generated calibration data in the on-board memory of the display panel comprises updating the previous calibration data in the on-board memory with the generated calibration data.

6. The display calibration method according to claim 1, wherein:

the on-board memory comprises a timing controller (TCON) provided on-board the display panel for driving the display panel, and the measured one or more chromaticity values of the display panel are stored as Extended Display Identification Data (EDID) or DisplayID Data in the TCON.

7. The display calibration method according to claim 1, wherein the one or more calibration operations performed for the display panel include white point calibration, gray tracking calibration, and panel response calibration.

8. The display calibration method according to claim 1, wherein remeasuring each of the plurality of primary color chromaticity values of the display panel comprises measuring a maximum intensity of one or more primary color chromaticities of the display panel while driving the display panel in the calibrated state based on the generated calibration data.

9. The display calibration method according to claim 8, wherein a chromaticity value of at least one of the primary color chromaticities of the display panel measured while driving the display panel in the calibrated state is different from a chromaticity value of the at least one of the primary color chromaticities of the display panel measured while driving the display panel in the native state.

10. The display calibration method according to claim 1, wherein measuring the native response of the display panel for each of a plurality of primary color chromaticity values comprises measuring a chromaticity value of one or more primary colors of the display panel using a measurement instrument while driving the display panel without any corrections being applied based on the calibration data.

11. A display calibration system, comprising:

a display panel;

a measurement unit;

memory; and one or more processors operatively coupled to the display panel, the measurement unit, and the memory, wherein the memory comprises instructions that, when executed by the one or more processors, cause the one or more processors to:

initialize the display panel to a native state;

measure a native response of the display panel with the measurement unit for each of a plurality of primary color chromaticity values;

perform one or more calibration operations for the display panel based on the measured native response;

generate calibration data for the display panel based on the one or more calibration operations;

store the generated calibration data in an on-board memory of the display panel;

remeasure each of the plurality of primary color chromaticity values of the display panel while driving the display panel in a calibrated state based on the generated calibration data;

determine a discrepancy between the remeasured plurality of primary color chromaticity values and a plurality of advertised primary color chromaticity values for the display panel, wherein determining a discrepancy further comprises, for at least one primary color, determining that at least one of the remeasured chromaticity values for the at least one primary color fall to the outside of a native chromaticity triangle of the display panel;

store, in response to determining a discrepancy, the remeasured plurality of primary color chromaticity values of the display panel into the on-board memory; and update the generated calibration data based on the remeasured plurality of primary color chromaticity values.

12. The display calibration system according to claim 11, wherein the memory further comprises instructions that, when executed by the one or more processors, cause the one or more processors to receive an indication to calibrate the display panel from a user, wherein the display panel is initialized to the native state, and the native response of the display panel is measured in response to receiving the indication to calibrate the display panel.

13. The display calibration system according to claim 12, wherein the instructions that cause the one or more processors to initialize the display panel to the native state comprise instructions that, when executed by the one or more processors, cause the one or more processors to bypass calibration data stored in the on-board memory of the display panel so as to drive the display panel without any corrections being applied based on the calibration data.

14. The display calibration system according to claim 12, wherein the indication to calibrate the display panel is received from the user via a user interface of the display calibration system, and wherein the memory further comprises instructions that, when executed by the one or more processors, cause the one or more processors to:

receive via the user interface an indication of the measurement unit to be used for measuring the native response of the display panel.

15. The display calibration system according to claim 11, wherein:

the on-board memory comprises a timing controller (TCON) provided on-board the display panel for driving the display panel, and the measured one or more chromaticity values of the display panel are stored as Extended Display Identification Data (EDID) or DisplayID Data in the TCON.

16. The display calibration system according to claim 11, wherein the instructions that cause the one or more processors to remeasure each of the plurality of primary color chromaticity values of the display panel comprise instructions that, when executed by the one or more processors, cause the one or more processors to measure a maximum intensity of one or more primary color chromaticities of the display panel while driving the display panel in the calibrated state based on the generated calibration data.

17. The display calibration system according to claim 16, wherein a chromaticity value of at least one of the primary color chromaticities of the display panel measured while driving the display panel in the calibrated state is different from a chromaticity value of the at least one of the primary color chromaticities of the display panel measured while driving the display panel in the native state.

18. A non-transitory program storage device, readable by one or more programmable control devices and comprising instructions stored thereon to cause the one or more programmable control devices to:

initialize a display panel to a native state;

measure a native response of the display panel with a measurement unit for each of a plurality of primary color chromaticity values;

perform one or more calibration operations for the display panel based on the measured native response;

generate calibration data for the display panel based on the one or more calibration operations;

store the generated calibration data in an on-board memory of the display panel;

remeasure each of the plurality of primary color chromaticity values of the display panel while driving the display panel in a calibrated state based on the generated calibration data;

determine a discrepancy between the remeasured plurality of primary color chromaticity values and a plurality of advertised primary color chromaticity values for the display panel, wherein determining a discrepancy further comprises, for at least one primary color, determining that at least one of the remeasured chromaticity values for the at least one primary color fall to the outside of a native chromaticity triangle of the display panel;

store, in response to determining a discrepancy, the remeasured plurality of primary color chromaticity values of the display panel into the on-board memory; and update the generated calibration data based on the remeasured plurality of primary color chromaticity values.

19. The non-transitory program storage device of claim 18, wherein the instructions further cause the one or more programmable control devices to receive an indication to calibrate the display panel from a user, wherein the display panel is initialized to the native state, and the native response of the display panel is measured in response to receiving the indication to calibrate the display panel.

20. The non-transitory program storage device of claim 19, wherein the instructions that cause the one or more programmable control devices initialize the display panel to the native state comprise instructions that cause the one or more programmable control devices to bypass calibration data stored in the on-board memory of the display panel so as to drive the display panel without any corrections being applied based on the calibration data.

* * * * *